United States Patent [19]

Hard

[11] 4,088,194

[45] May 9, 1978

[54] COMBINATION GAUGE SHIELD AND LOCK PIN FOR A FIRE EXTINGUISHER

[75] Inventor: Harold D. Hard, Columbus, Ohio

[73] Assignee: The MAP Corporation, Bowling Green, Ohio

[21] Appl. No.: 740,408

[22] Filed: Nov. 10, 1976

[51] Int. Cl.[2] ..... A62C 13/00

[52] U.S. Cl. ..... 169/75; 73/431; 169/89

[58] Field of Search ..... 169/75, 74, 89, 51, 169/88; 73/431, 420, 389; 239/288.5

[56] References Cited

U.S. PATENT DOCUMENTS

| | | | |
|---|---|---|---|
| 3,016,097 | 1/1962 | Paus et al. | 169/75 |
| 3,061,014 | 10/1962 | Forrester et al. | 169/75 X |
| 3,844,356 | 10/1974 | Allen et al. | 169/88 X |

FOREIGN PATENT DOCUMENTS

| | | | |
|---|---|---|---|
| 549,300 | 11/1957 | Canada | 169/89 |

*Primary Examiner*—Joseph F. Peters, Jr.
*Assistant Examiner*—Michael Mar
*Attorney, Agent, or Firm*—Hugh Adam Kirk

[57] ABSTRACT

A pressure gauge shield for the pressure gauge on a pressurized fire extinguisher, which shield is formed integrally with the locking pin for the control valve for operating the fire extinguisher. The lock pin, which comprises a finger-hole loop connected to the valve assembly by a chain, has a pair of parallel prongs, one of which extends through aligned holes between the lever and valve housing to prevent operation of the lever, and the other acts to prevent the rotation of the lock pin when in its locking position so as to maintain the position of a semi-circular shield over the top of the pressure gauge also connected to the valve assembly. A breakable connection, such as of plastic cord, is provided to hold the lock pin it its locking position, which cord must be broken to withdraw the lock pin in order to operate the fire extinguisher.

6 Claims, 5 Drawing Figures

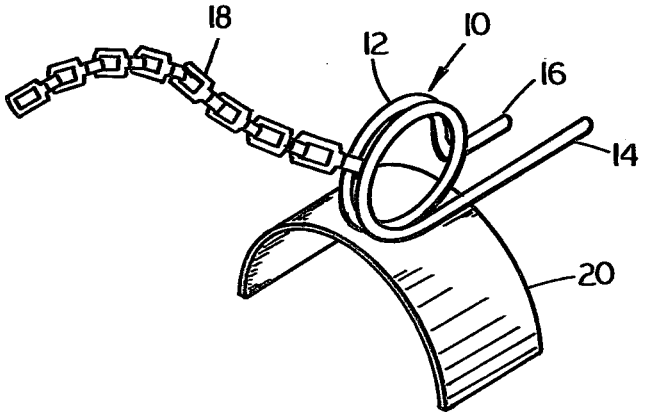
FIG. I
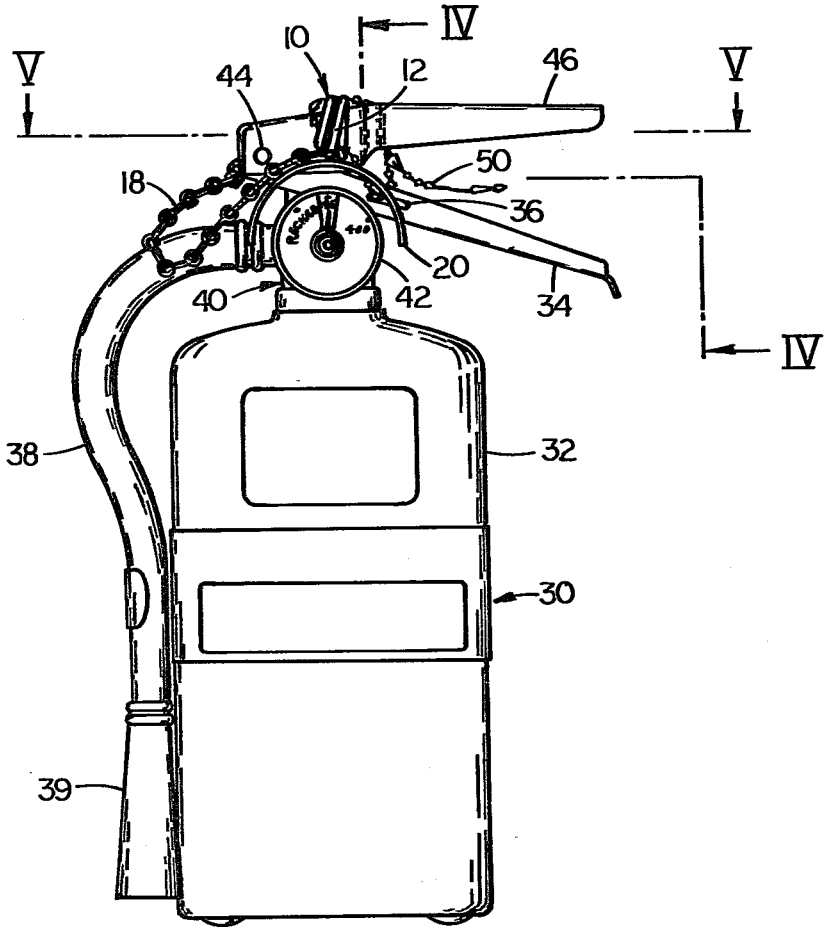
FIG. II

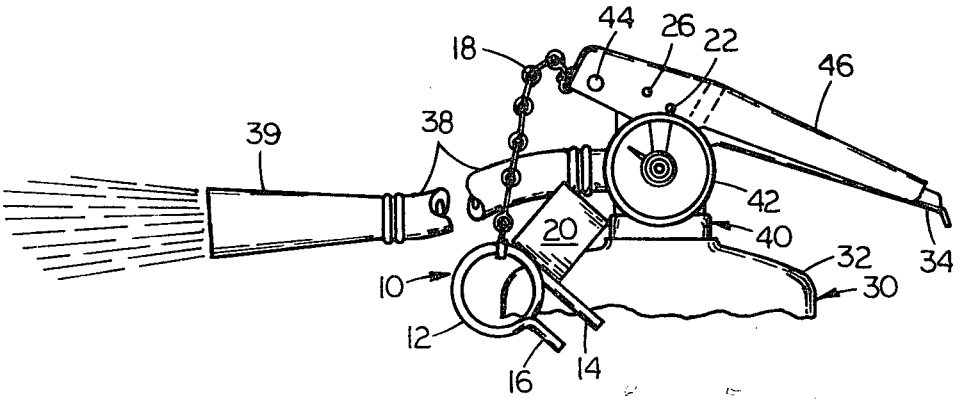
FIG. III
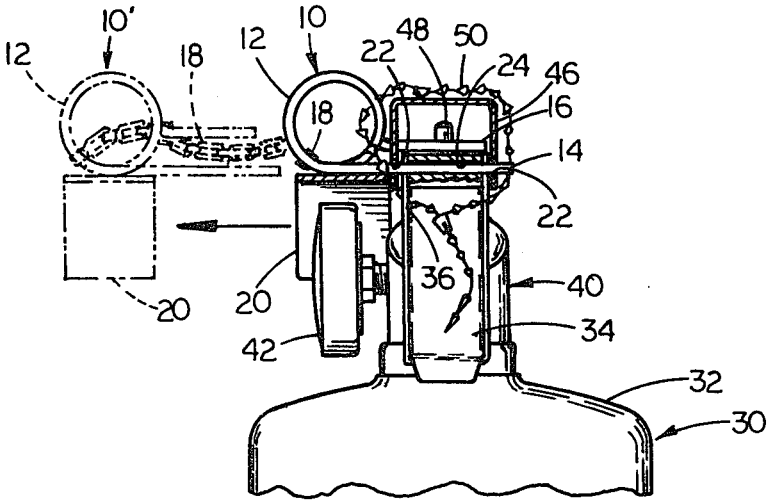
FIG. IV
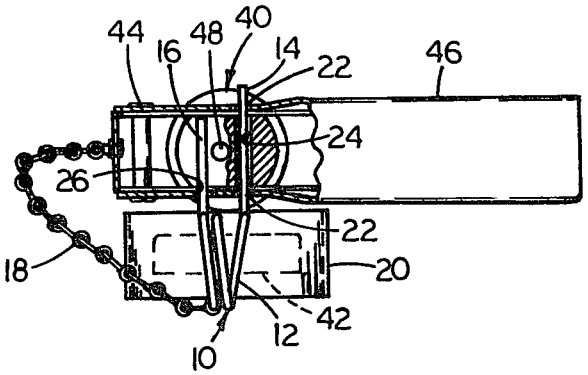
FIG. V

COMBINATION GAUGE SHIELD AND LOCK PIN FOR A FIRE EXTINGUISHER

BACKGROUND OF THE INVENTION

Previously, pressure gauges on fire extinguishers were protected by shields formed integrally with the valve housing or by separate members anchored thereto. Such shields required rather extensive and expensive modification of the valve housing or extinguisher container for their addition.

SUMMARY OF THE INVENTION

The combination locking pin and gauge guard or shield, according to preferred embodiment of this invention, comprises a locking pin having a finger loop with two parallel prongs extending outwardly in the same direction therefrom and preferably is made out of a single piece of wire or thin rod stock. Attached to one of these prongs, such as by welding adjacent the finger loop, is a semi-cylindrical or arch shaped hood or shield that is positioned over the top of the round dial housing of a pressure gauge for the fire extinguisher when the lock pin is in its locking position. Also attached to the finger loop may be a chain for attaching this locking-pin and shield assembly to part of the valve assembly.

The combination lock pin and guard assembly of this invention is particularly adapted for locking the pivoted hand lever at the upper end of a pressurized fire extinguisher, which lever controls the valve for releasing the contents of the fire extinguisher. The housing for this valve is provided with a pivot for said lever, as well as a connection for a pressure gauge for measuring the pressure inside the extinguisher to indicate whether it is pressurized enough for instant and proper operation. When the valve is closed, the lever for operating it is in a position wherein a hole through the lever aligns with a hole in the housing for the valve, and it is into these aligned holes that one of the prongs of the lock pin above described is inserted and/or seated for locking the lever to prevent unwarranted or accidental operation of the fire extinguisher. A separate or second hole or seat is provided adjacent the locking pin or prong hole in the lever for the other prong of the locking pin assembly, which prevents the rotation of the locking pin assembly to insure that the shield or guard attached to the ring of the locking pin will be maintained in a spaced protected position at least over the top half of the cylindrical pressure gauge housing attached to the valve assembly.

Furthermore, there is provided a breakable plastic cord or wire for holding the locking pin assembly in its valve locking position, such as a loop which may extend through the finger hole of the locking pin assembly and wrap around the handle lever.

Since the gauge is only used to determine whether or not the fire extinguisher has sufficient pressure of fluid therein to be operative, once the valve pin is removed and the extinguisher operated, the function of the pressure gauge is no longer important and accordingly a shield or guard therefor is no longer necessary. Thus, when the lock pin is removed by breaking the cord that holds it in position, the valve can be operated and the fire extinguisher used as any pressurized fire extinguisher normally would be used.

Accordingly it is an object of this invention to produce an efficient, effective, economic, and simple means for providing a shield for the pressure gauge on a pressurized fire extinguisher without redesign or the addition of further structure and/or modification of the valve assembly or adjacent portions of the fire extinguisher container for installing such a shield.

BRIEF DESCRIPTION OF THE DRAWINGS

The above-mentioned and other features, objects and advantages, and a manner of attaining them, are described more specifically below by reference to an embodiment of this invention shown in the accompanying drawings, wherein:

FIG. I is a prospective view of the combination locking pin and gauge guard according to a preferred embodiment of this invention;

FIG. II is a side elevation of a pressurized fire extinguisher with a pressure gauge thereon adjacent the valve assembly and the lever therefor with the lock pin and gauge guard shown in FIG. I in level locking position thereon;

FIG. III is a view of the upper portion of the fire extinguisher shown in FIG. I, showing the lock pin and guard assembly of FIG. I removed from its valve locking position and the lever operated for releasing the contents of the fire extinguisher;

FIG. IV is an enlarged sectional view taken along line IV—IV of FIG. II showing the locking pin and guard assembly in their locking position with the breakable cord holding them thus, and in dotted lines the removal of this pin and guard assembly for unlocking the lever; and FIG. V is an enlarged sectional view taken along line V—V of FIG. I showing the positions of the parallel prongs of the locking pin assembly and shield for over the pressure gauge.

DETAILED DESCRIPTION OF PREFERRED EMBODIMENT

Referring first to FIG. I, there is shown a preferred embodiment of a combination locking pin and gauge guard assembly 10 comprising a wire circular finger loop or ring 12 having projecting tangentially therefrom a locking pin or prong 14 at one end of the wire of the loop, and from the other end of the wire of the loop, a parallel projecting prong 16. A retaining chain 18 may be attached to the ring 12. A semi-circular shield 20 which surrounds and protects the top half of the pressure gauge 42 shown on the fire extinguisher in the other figures, is fixedly attached to the assembly 10 preferably being welded to the prong 14 adjacent the ring 12.

Referring to the other Figures, there is shown either fully or partially a fire extinguisher 30 having a pressurized container 32 at the top of which is a valve assembly 40 which has connected thereto a pressure gauge 42 and a pivot 44 for a handle or lever 46 for operating the valve by depressing the valve stem 48 (see FIGS. IV and V). Below this lever 46 is a supporting handle 34 attached to the valve assembly 40 which also may support the pivot 44. When the lever 46 is in its locked position or non-operative position, holes 22 on the opposite side thereof align with a hole 24 (see FIGS. IV and V) in the housing of the valve assembly 40 for seating the locking prong or pin 14. Adjacent and parallel to one of the holes 22 there may be provided another hole 26 in the side of the handle lever 46 for insertion of the prong 16 of the locking pin assembly 10 to prevent rotation of the assembly 10 around the prong 14 when it is in its locking position shown in FIGS. IV and V.

Thus the only modification that needs to be made to provide the shield 20 for the gauge 42 is the addition of the hole 26 into the handle lever 46.

The chain 18 may be anchored to the valve assembly housing 40 or the end of the supporting handle 34 as shown in FIG. V. This chain 18 retains the locking pin assembly 10 from being lost, so that after the contents of the fire extinguisher 30 have been emptied, the container 32 can be recharged and the pin assembly 10 can be used again.

In order to prevent the pin assembly 10 from being accidentally or unauthorizedly removed from its locking position as shown in FIGS. II, IV, and V, there preferably is provided a breakable cord 50 as shown in FIGS. II and IV, which may be looped through the ring 12 and surround the lever 46. It also may be passed through an aperture 36 in the handle 34 (see FIGS. II and IV). This cord 50 may be made of plastic with slip-knot stops thereon as shown, or may be of wire that can be easily broken by a quick jerk in the direction of the arrow to the position 10' shown in FIG. IV. This removes the locking pin assembly 10 so that the lever 46 may be depressed as shown in FIG. III. The depression of the lever 46 pushes against the valve stem 48 to open the valve in the assembly 40 to dispense the contents of the fire extinguisher 30 out through the hose 38 and its nozzle 39 as shown in FIG. III as for extinguishing a fire.

While there is described above the principles of this invention in connection with a specific apparatus, it is to be clearly understood that this description is made only by way of example, and not as a limitation to the scope of this invention.

I claim:

1. In a pressurized fire extinguisher having a valve, a handle for operating said valve, a pressure gauge adjacent said valve, and a removable lock pin for preventing the operation of said valve, the improvement comprising:

(A) a shield welded to said locking pin for shielding at least the upper portion of said gauge, (B) means for preventing the rotation of said lock pin while in its valve locking position, and (C) a breakable connection between said locking pin and said handle for normally preventing the removal of said locking pin from its valve locking position.

2. A fire extinguisher according to claim 1 including a flexible connection between the locking pin and said valve.

3. A fire extinguisher according to claim 1 wherein said locking pin comprises a finger loop with a pair of parallel prongs extending therefrom, one of which engages said handle and valve for preventing the operation of said valve, and the other of which prongs engages said handle for preventing the rotation of said locking pin around said one prong.

4. A fire extinguisher according to claim 1 wherein said means for preventing the rotation of said locking pin comprises a second pin parallel to said locking pin which engages said handle.

5. A combination lock pin and gauge guard for a portable pressurized fire extinguisher having a vent valve, a pivoted lever for operating said valve, and an adjacent pressure gauge, said combination comprising:

(A) a locking pin having a pull ring and two parallel prongs extending therefrom in the same direction, (B) a guard for at least over the top of said gauge welded to said ring, (C) parallel seats in said lever for said prongs, one of which seats aligns with a seat in the housing of said valve for locking said lever from pivotal movement, and both of said seats locking said pin and guard combination from pivotal movement around either said prong, and (D) a breakable connection between said ring and said lever to prevent the unwarranted separation of said prongs from said seats.

6. A pin and guard combination according to claim 5 including a flexible connection between said ring and the housing of said valve.

* * * * *